US005297390A

United States Patent [19]

Sood

[11] Patent Number: 5,297,390

[45] Date of Patent: Mar. 29, 1994

[54] FUEL INJECTION NOZZLE HAVING TIP COOLING

[75] Inventor: Virendra M. Sood, Encinitas, Calif.

[73] Assignee: Solar Turbines Incorporated, San Diego, Calif.

[21] Appl. No.: 973,892

[22] Filed: Nov. 10, 1992

[51] Int. Cl.[5] ..... F02C 1/00

[52] U.S. Cl. ..... 60/740; 60/742

[58] Field of Search ..... 60/733, 737, 740, 742, 60/746, 748, 752; 239/132, 132.3, 132.5

[56] References Cited

U.S. PATENT DOCUMENTS

| | | | |
|---|---|---|---|
| 3,644,076 | 2/1972 | Bagge | 239/132.3 |
| 3,684,186 | 8/1972 | Helmrich | 60/742 |
| 3,685,741 | 8/1972 | O'Sickey | 60/742 |
| 4,180,974 | 1/1980 | Stenger et al. | 60/748 |
| 4,290,558 | 9/1981 | Coburn et al. | 60/748 |
| 4,432,534 | 2/1984 | Zanetta et al. | 239/132.3 |
| 4,454,711 | 6/1984 | Ben-Porat | 60/748 |
| 4,858,538 | 8/1989 | Kuypers et al. | 239/132.3 |
| 5,211,004 | 5/1993 | Black | 60/737 |

*Primary Examiner*—Richard A. Bertsch
*Assistant Examiner*—Timothy S. Thorpe
*Attorney, Agent, or Firm*—Larry G. Cain

[57] ABSTRACT

The present system or structure for cooling a combustion end of a fuel injection nozzle is accomplished by providing a cooling passage for skin cooling of the portion of the nozzle directly exposed to the combustion flames. A twofold path is provided through which cooling air can enter cooling passages and cool an end portion of a second member and a tip. A first flow path is intended to primarily cool the tip and further cool the end portion. A second flow path is intended to ensure primary cooling of the end portion Thus the combustor end of the fuel injection nozzle is maintained at a temperature low enough to prevent failure of the combustor end through oxidation, cracking and buckling. Both the cooling flow paths dump the spent air in a cavity formed between the injector nozzle and a combustor. The spent cooling air becomes a part of the main combustion air and, therefore, does not adversely affect the combustion process in general and NOx and CO emissions in particular. Low NOx is further maintained by using a device for supplying combustible fuel into each of a plurality of spaces formed between a plurality of radial swirler vanes.

7 Claims, 5 Drawing Sheets

FUEL INJECTION NOZZLE HAVING TIP COOLING

DESCRIPTION

1. Technical Field

This invention relates generally to gas turbine engines and more particularly to the unique structural arrangement for cooling the tip of a fuel injection nozzle in a manner such that the cooling air does not adversely affect the combustion process.

2. Background Art

The use of fossil fuel in gas turbine engines results in the combustion temperature which in many application causes premature failure of the fuel injection nozzle end through oxidation, cracking and buckling. The fuel injection nozzle end must, therefore, be cooled to increase the design life of the fuel injectors.

Attempts have been made to cool the nozzle end and increase the life of such components. One such example, of a nozzle which has attempted to cool the end thereof is disclosed in U.S. Pat. No. 4,600,151 issued Jul. 15, 1986 to Jerome R. Bradley. The injector assembly includes a plurality of sleeve means one inside the other in spaced apart relation. An inner air-receiving chamber and an outer air-receiving chamber for receiving and directing compressor discharge air into the fuel spray cone and/or water or auxiliary fuel from the outside for mixing purposes. The air streams exit directly into the combustion zone wherein mixing with fuel and combustion occurs.

Another attempt to cool a nozzle is disclosed in U.S. Pat. No. 4,483,137 issued Nov. 20, 1984 to Robie L. Faulkner. This cooling system includes a central air passage and a twofold air flow directed by a secondary air swirl vane and a radially extending swirl vane. Each of the air streams exit directly into the combustion zone wherein mixing with fuel and combustion occurs.

Many of the cooling schemes of the past discharge the spent cooling air into the combustion chamber where it can adversely affect the combustion process. In the invention described herein the cooling air flow becomes a part of the combustion air prior to entering the combustion chamber. Therefore, its effect on the combustion process in general and NOx and CO emissions in particular is minimized.

DISCLOSURE OF THE INVENTION

In one aspect of the invention, a gas turbine engine includes a central axis, a compressor section, a turbine section and a combustor section positioned operatively therebetween. The compressor section causes a flow of compressed air during operation of the gas turbine engine. The combustor section includes a combustor axis having an outer combustor housing coaxially positioned about the combustor axis and has a combustor coaxially aligned about the combustor axis. The combustor has a generally cylindrical outer shell coaxially positioned about the combustor axis and radially inwardly spaced from the outer combustor housing forming an air gallery therebetween. The outer shell has an outlet end portion and an inlet end portion having an inlet opening positioned near the inlet end portion and has a fuel injection nozzle positioned therein. A plurality of swirler vanes are radially positioned in the inlet opening externally of the fuel injection nozzle and the plurality of swirler vanes have a preestablished space therebetween. A means for supplying a combustible fuel into the preestablished space between the swirler vanes and another means for supplying combustible fuel to the fuel injection nozzle generally along the combustor axis are also included.

In another aspect of the invention, a fuel injection nozzle has a nozzle axis and is comprised of a cylindrical housing coaxially positioned about the nozzle axis. The housing has a generally closed first end portion, a second end portion and defines a plurality of passages intermediate the first and second end portions. The nozzle includes a first member having a generally cup shaped contour includes a generally radial end portion and the nozzle has an end attached to the cylindrical housing intermediate the first and second end portions. The generally radial end portion is attached to the other end of the cylindrical axial portion and has an opening centrally positioned therein. A second member includes a generally cup shaped contour and has an end attached to the cylindrical housing intermediate the first end portion and the first member. The second member further includes a generally radial end portion having an opening centrally positioned therein. Further included is a cooling passage formed generally between the first member and the second member. The cooling passage is in communication with the plurality of passages. And, a tip is positioned in the openings coaxial with the nozzle axis and is sealingly attached to the second member. A means for supplying a combustible fuel to the fuel injection nozzle and a means for communicating a flow of cooling fluid through the cooling passage during operation of a gas turbine engine ar also included.

BEST MODE FOR CARRYING OUT THE INVENTION

Figure 1:
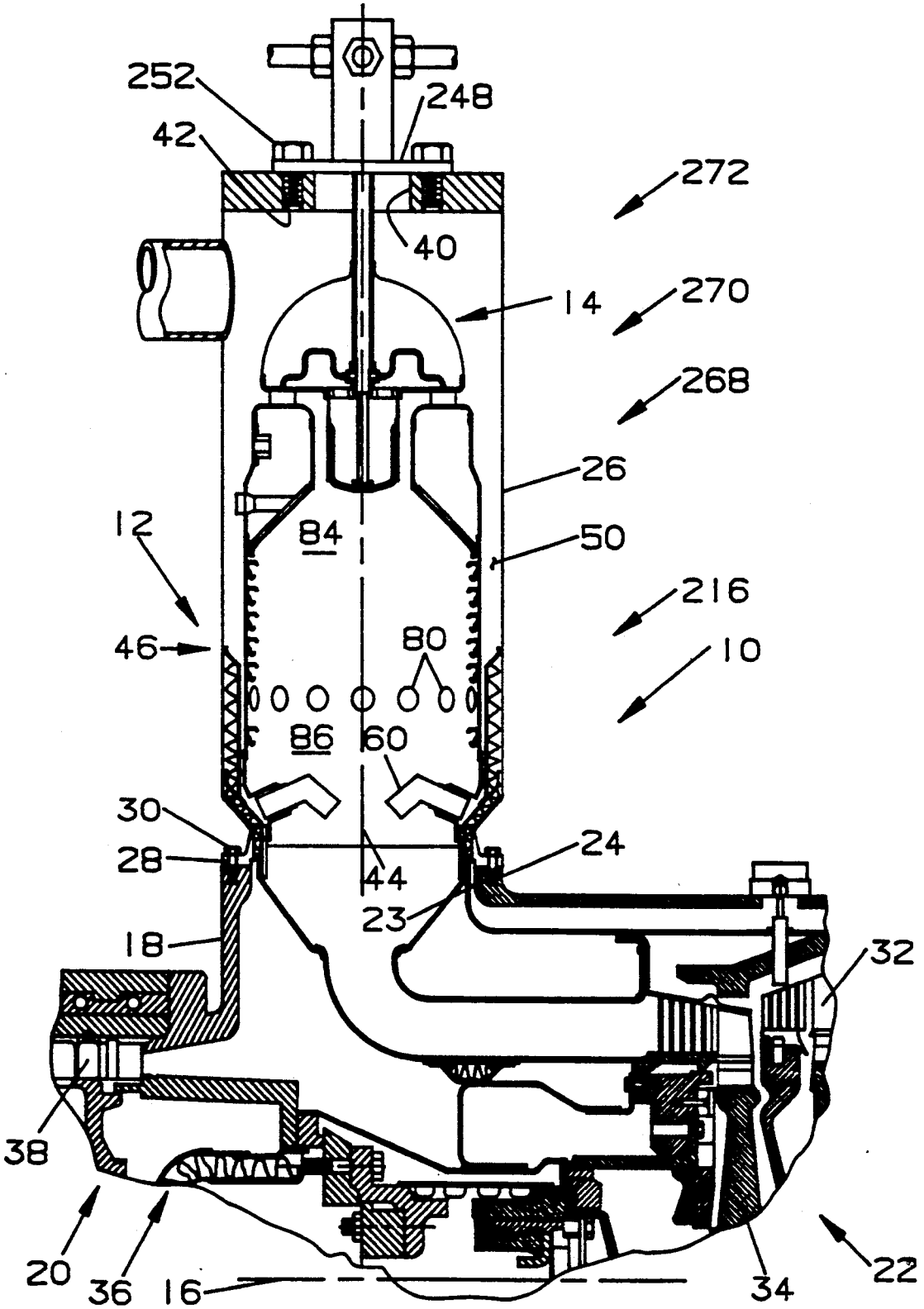
FIG. 1 is a partially sectioned side view of a gas turbine engine having an embodiment of the present invention.

In reference to FIG. 1, a gas turbine engine 10 having a side mounted combustor section 12 including a fuel injection nozzle 14 is shown. As an alternative to the side mounted combustor 12 any type of combustor such as a axial in line annular combustor or a plurality of can type combustors could be incorporated without changing the gist of the invention. The gas turbine engine 10 has a central axis 16 and an outer housing 18 coaxially positioned about the central axis 16. The housing 18 is positioned about a compressor section 20 centered about the axis 16 and a turbine section 22 centered about the axis 16. The combustor section 12 is positioned operatively between the compressor section 20 and the turbine section 22. Positioned within the housing 18 intermediate the compressor section 20 and the turbine section 22 is an opening 23 having a plurality of threaded holes 24 positioned therearound. An outer combustor housing 26, which is a part of the side mounted combustor section 12, has a plurality of holes 28 therein corresponding to the plurality of threaded holes 24 around the opening 23 and is positioned about the opening 23. A plurality of bolts 30 removably attach the combustor housing 26 to the outer housing 18.

The turbine section 22 includes a power turbine 32 having an output shaft, not shown, connected thereto for driving an accessory component such as a generator. Another portion of the turbine section 22 includes a gas producer turbine 34 connected in driving relationship to the compressor section 20. The compressor section 20, in this application, includes an axial staged compressor 36 having a plurality of rows of rotor assemblies 38, of which only one is shown. When the engine 10 is operating, the compressor 36 causes a flow of compressed air to be used for combustion and cooling. The compressed air is ducted to the side mounted combustor section 12 in a conventional manner, such as through a portion of the duct shown in FIG. 1. As an alternative, the compressor section 20 could include a radial compressor or any source for producing compressed air.

Figure 2:
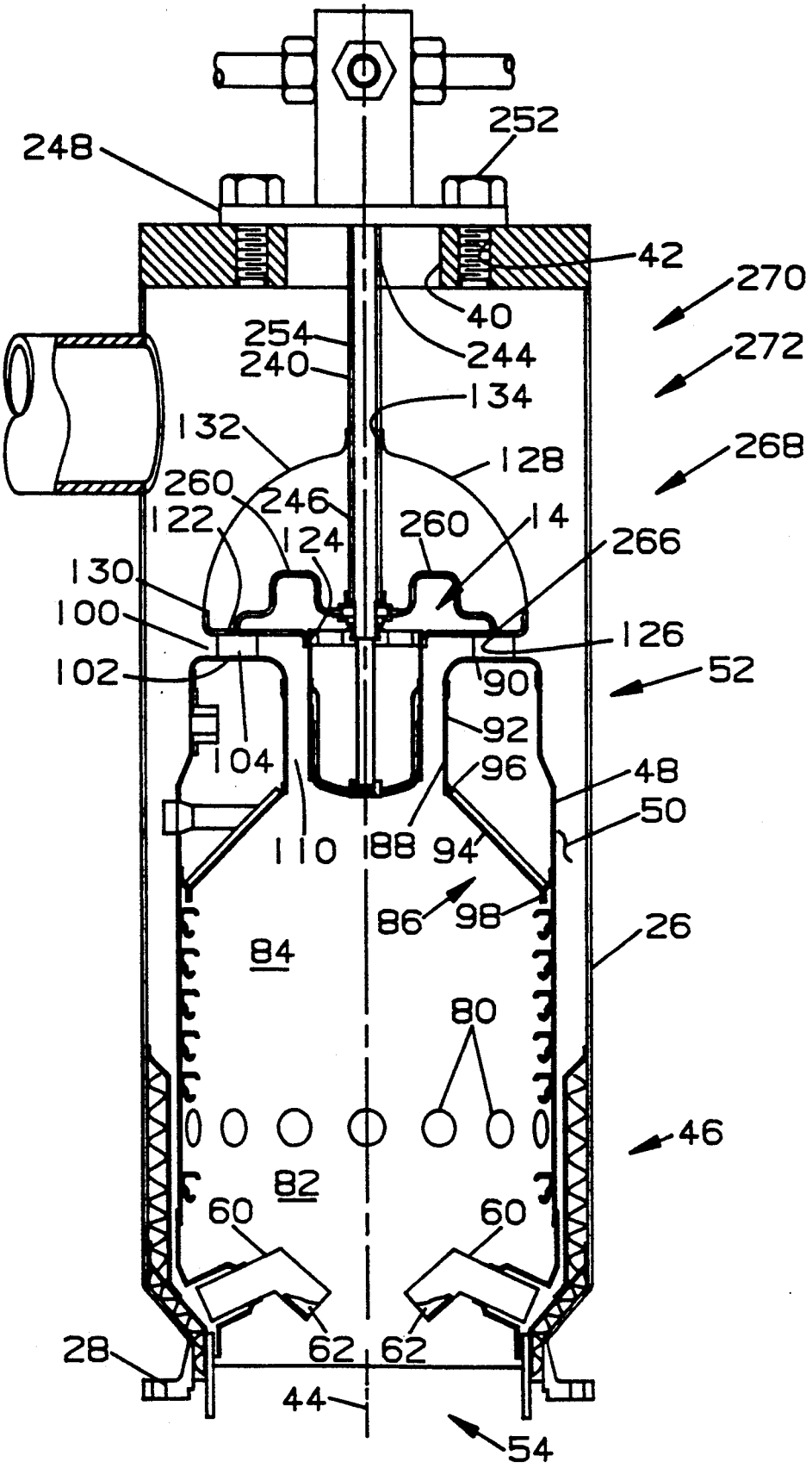
FIG. 2 is an enlarged sectional view of a combustor used in one embodiment of the present invention.

In this application and best shown in FIG. 2, the side mounted combustor section 12 includes the combustor housing 26 having an opening 40 therein and a plurality of threaded holes 42 positioned therearound. The combustor housing 26 is coaxially positioned about a combustor axis 44 being perpendicular to the central axis 16. The side mounted combustor section 12 further includes a can combustor 46 coaxially aligned about the combustor axis 44. The combustor 46 is supported from the outer combustor housing 26 in a conventional manner. The combustor 46 has a generally cylindrical outer shell 48 being coaxially positioned about the combustor axis 44 and radially spaced a preestablished distance from the outer combustor housing 26 forming an air gallery 50 therebetween. The outer shell 48 has an inlet end portion 52 and an outlet end portion 54. Positioned radially inward of the outer shell 48 is a plate assembly 86 including an upside down "L" shaped cowling 88 having a short leg member 90 and a long leg member 92. An end of the short leg member 90 is attached to the outer shell 48 at the inlet end portion 52 and the other end of the short leg member 90 is attached to an end of the long leg member 92. Another end of the long leg member 92 is attached to a bevel ring member 94 at a first end 96 thereof and a second end 98 thereof is attached to the outer shell 48. Thus, the bevel ring member 94 is tapered from the leg member 92 outwardly toward the outlet end portion 54.

An inlet opening 99 is radially disposed between the short leg member 90 and a circular end plate 100. The circular end plate 100 includes an outer portion 101 positioned near its circumference. The circular end plate 100 is coaxially positioned about the combustor axis 44 and is in contacting relationship at the outer portion 101 with a plurality of swirler vanes 102 having a preestablished space 104.therebetween. The injection nozzle 14 is coaxially aligned with the combustor axis 44 and forms a generally annular cavity 110 between the injection nozzle 14 and the long leg member 92. An opening 124 in the plate 100 is positioned about the injection nozzle 14. A plurality of holes 126 within the plate 100 are circumferentially evenly spaced about the combustor axis 44 and are aligned to exit the plate 100 in the preestablished space 104 between each of the plurality of swirler vanes 102. A cup shaped cover 128 including a lip portion 130 is attached to the plate 100 and includes a bowl portion 132 having an opening 134 therein. The lip portion 130 is attached near the outer periphery of the end plate 100.

Figure 3:
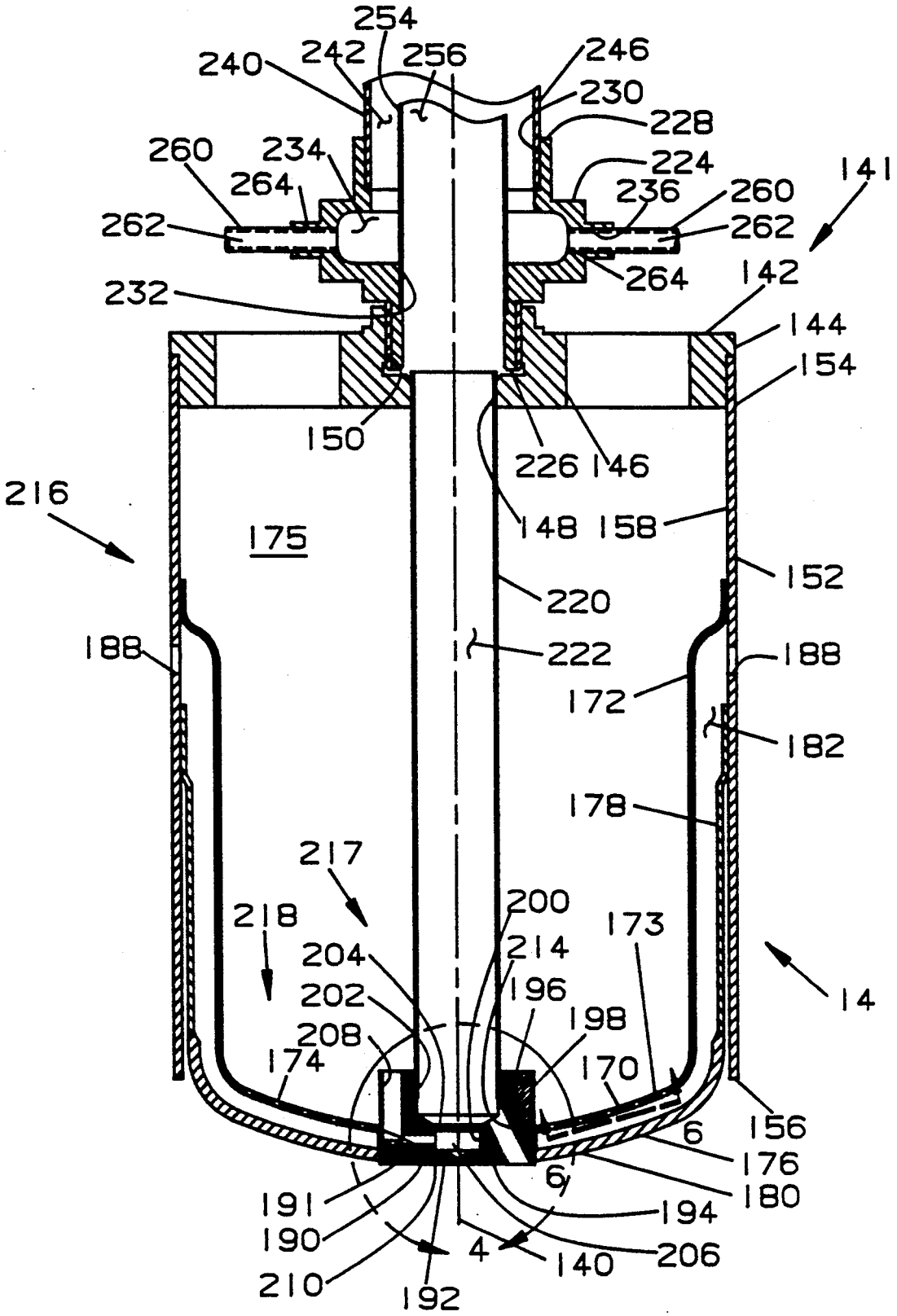
FIG. 3 is an enlarged sectional view of a fuel injection nozzle used in one embodiment of the present invention.
Figure 6:
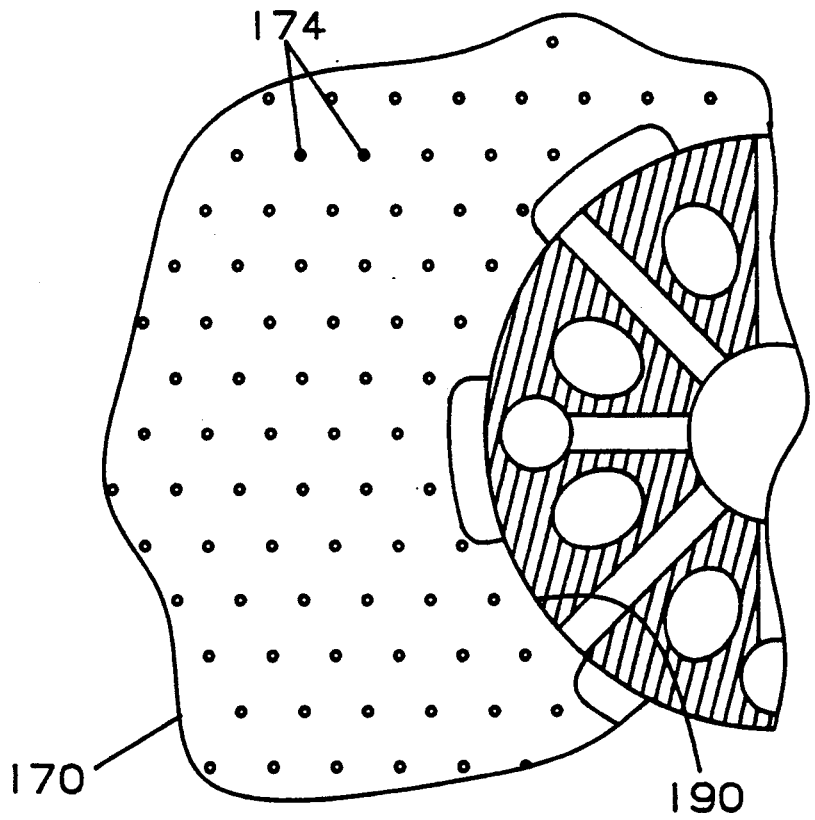
FIG. 6 is an enlarged sectional view of a portion of the fuel injection nozzle taken along lines 6—6 of FIG. 3.

As best shown in FIG. 3, the fuel injection nozzle 14 has a nozzle axis 140 coaxial with the combustor axis 44 in the assembled position and is supported from the combustor housing 26 in a conventional manner, as will be explained later. The fuel injection nozzle 14 has a generally closed inlet end 141, which in this application, includes a cylindrical backing plate 142 being coaxial with the nozzle axis 140. The plate 142 includes a stepped outer contour 144 and has a plurality of holes 146 evenly spaced and radially positioned about the nozzle axis 140. In this application, eight holes having a diameter of about 22.0 mm are used. A center hole 148 having a stepped surface 150 is positioned in the plate 142 and is centered about the nozzle axis 140. A cylindrical housing 152 having a first end portion 154, a second end portion 156 and an inner surface 158 is attached to the stepped outer contour 144 at the first end portion 152. A first member 170 being of a relative thin material or skin, approximately 1.5 mm thick, has a generally cup shaped contour, and a generally cylindrical axial portion 172 having an expanded end attached to the inner surface 158 intermediate the first and second end portions 154, 156. The first member 170 further has a generally radial end portion 173, which in this application is generally spherical, attached to the other end of the cylindrical axial portion 172. The end portion 173 has a plurality of holes 174 therein. As best shown in FIG. 6 in this application, the holes 174 are positioned in a generally honey comb configuration. The hexagonal pattern of the honey comb includes one of the holes 174 at each of the vertices of the hexagonal and another of the holes 174 centered therein. The spacing, size and gap between each of the holes 174 is controlled in a preestablished manner depending on the heat input from the combustion gases. Formed between the first member 170, the inner surface 158 of the cylindrical housing and the backing plate 142 is a cooling reservoir 175. A second member 176 being of a relative thin material or skin but greater than the first member 170, approximately 3.0 mm thick, has a generally cup shaped contour includes a generally cylindrical axial portion 178 having an expanded end attached to the inner surface 158 intermediate the second end portion 156 and the first member 170. A radial end portion 180 having a generally spherical configuration is attached to the other end of the cylindrical axial portion 178. Thus, the position of the first member 170 relative to the second member 176 and a portion of the inner surface 158 of the cylindrical housing 154 has a preestablished spaced distance therebetween which forms a cooling passage 182. Positioned in the housing 154 intermediate the expanded ends of the first member 170 and the second member 176 is a plurality of passages 188 which provides communication from the cooling passage 182 through the housing 154 into at least a portion of the spaces 104. In this application, sixteen (16) passages 188 having approximately a 6.86 mm diameter are equally positioned in the cylindrical housing 154 about its perimeter. Each of the first and second members 170,176 has an opening 190,191 respectively centrally positioned in the respective end portions 173,180. The opening 190 in the first member 170 has a generally scalloped contour, as shown in FIG. 6. A tip 192 is positioned in the openings 190, 191, is coaxial with the nozzle axis 140, is attached to the second member 176 and is in contact with a portion of the scalloped contour of the opening 190 in the first member 170.

Figure 4:
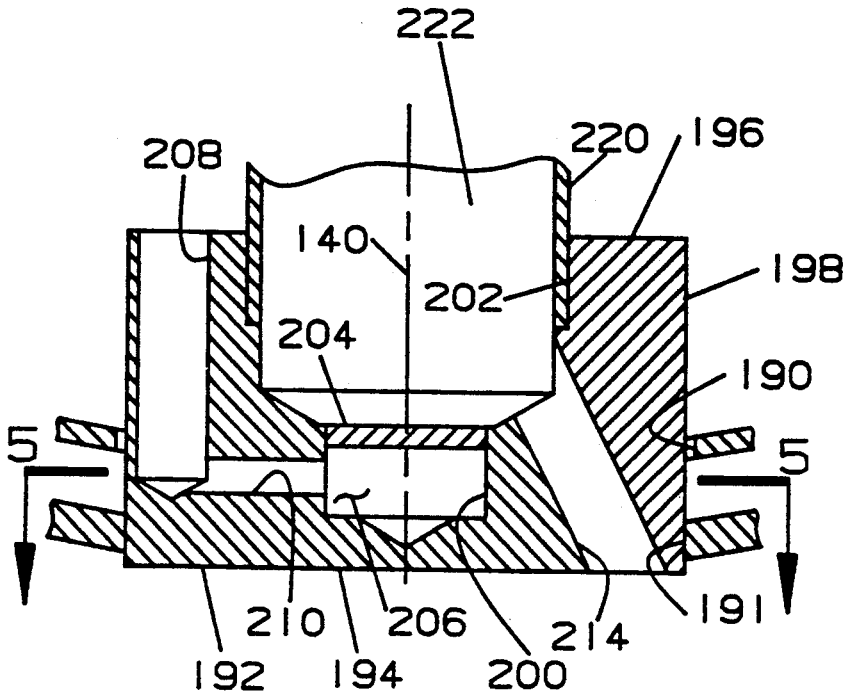
FIG. 4 is an enlarged sectional view of a tip of the fuel injection nozzle taken within line 4 of FIG. 3.
Figure 5:
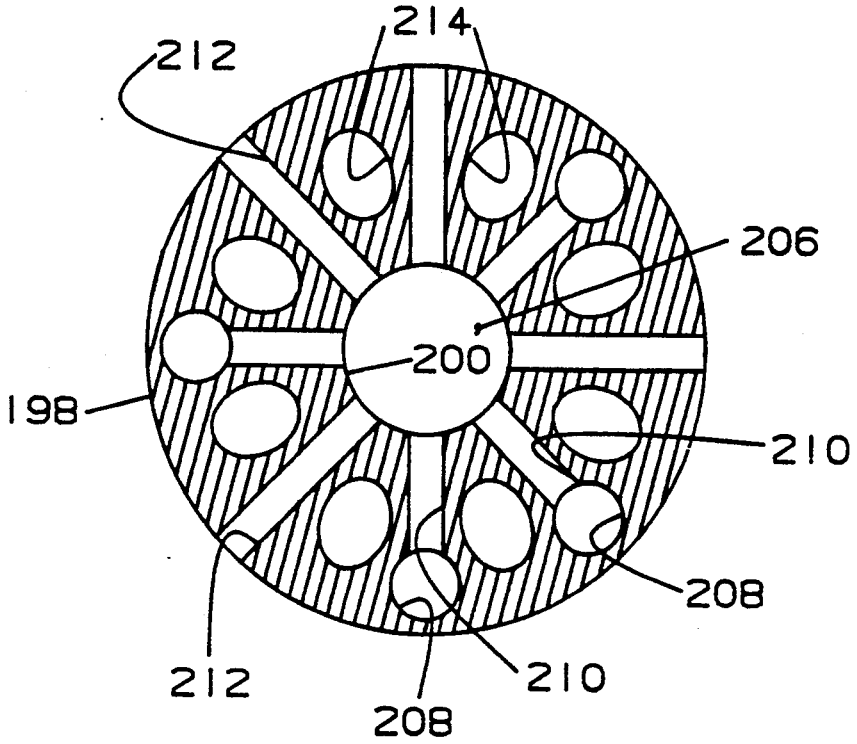
FIG. 5 is an enlarged sectional view of the tip taken along lines 5—5 of FIG. 4.

As best shown in FIG. 3, 4 and 5, the tip 192 has a generally cylindrical shape having a combustor face 194, a back face 196 and an outer surface 198 extending between the combustor face 194 and the back face 196. As stated above, the outer surface 198 is positioned in the opening 190 and contacts only a portion of the scalloped surface. The outer surface 198 is also positioned in the passage 191 and is attached in sealing relationship to the spherical portions 180 of the second members 176. The tip 192 has a first central bore 200 entering the back face 196 and has a predetermined depth which bottoms within the tip 192. A second central bore 202 being larger than the first central bore 200 enters the back face 196, is coaxial with the first central bore 200 and has a predetermined depth which bottoms short of the bottom of the first central bore 200. A plate 204 is positioned in the first central bore 200 and sealing forms a chamber 206. The tip 192 further includes a plurality of passages 208, only one shown, entering through the back face 196, radially spaced from the nozzle axis 140 and has a predetermined depth which bottoms within the tip 192 between the back face 196 and the combustor face 194. Each of the plurality of passages 208 is in communication with the first central bore 200 by way of a radial bore 210 which intersects with a corresponding one of the plurality of passages 208. The cooling passage 182 is in communication with the chamber 206 by way of a plurality of radial passages 212, as best shown in FIG. 5. The passages 212 pass through the outer surface 198 and intersects the chamber 206. In this application, the plurality of passages 208 include four passages 208 having about a 0.183 mm diameter and the plurality of radial bores 210 include four bores 210 having about a 0.082 mm diameter.

The radial passages 212 include four passages 212 having about a 0.082 mm diameter. Thus, a communication path is established from the cooling reservoir 175, through the tip 192 to the cooling passage 182. A plurality of angled passages 214 are evenly spaced along the combustor face 194 near the outer surface 198 and extend into the second central bore 202. In this application, the angled passages 214 include eight angled passages 214 angled at about 30 degrees to the nozzle axis 140 and have about a 0.181 diameter.

A means 216 for communicating a flow of cooling fluid through the cooling passage 182 includes a first flow path 217 through the plurality of holes 146 in the plate 142, the cooling reservoir 175, the plurality of passages 208 in the tip, the radial bores 210, the chamber 206, the plurality of radial passages 214 and the plurality of passages 188 in the housing 154. The means 216 for communicating a flow of cooling fluid through the cooling passage 182 further includes a second flow path 218 through the plurality of holes 146 in the plate 142, the cooling reservoir 175, the plurality of holes 174 in the end portion 173 and the plurality of passages 188 in the housing 154.

As best shown in FIG. 3, attached within the second central bore 202 of the tip 192 and the center hole 148 in the plate 142 is a tubular member 220 having a passage 222 therein A manifold 224 having a nozzle end portion 226 is positioned in a portion of the stepped inner surface 150 and is sealingly attached thereto. A supply end portion 228 of the manifold 224 has a large bore 230 and the nozzle end portion 226 has a smaller bore 232 therein. A reservoir 234 is positioned in the manifold 224 intermediate the nozzle end portion 226 and the supply end portion 228. A plurality of openings 236 are evenly circumferentially spaced about the reservoir 234.

As stated above and best shown in FIGS. 1, 2 and 3, the conventional manner in which the fuel injector nozzle 14 is attached includes an outer tubular member 240 having a passage 242 therein. The outer tubular member 240 includes an inlet end portion 244 and an outlet end portion 246 sealingly attached in the bore 230. The outer tubular member 240 extends axially through the opening 40 in the outer combustor housing 26 and has a mounting flange 248 extending therefrom. The flange 248 has a plurality of holes therein, not shown, in which a plurality of bolts 252 threadedly attach to the threaded holes 42 in the outer combustor housing 26. Thus, the injector 14 is removably attached to the outer combustor housing 26. The passage 242 is in fluid communication with a source of fuel, not shown. Coaxially positioned within the passage 242 is an inner tubular member 254 having an end attached within the passage 232. A passage 256 within the inner tubular member 254 communicates with a source of fuel and the plurality of angled passages 214 in the tip 192 by way of the passage 222 within the tubular member 220.

A plurality of tubes 260 each having a passage 262 therein and a first end 264 is attached in respective ones of the plurality of openings 236 and a second end 266 is attached in respective ones of the plurality of holes 126 in the circular end plate 100. The tubes 260 thus, communicate between the reservoir 234 and the respective spaces 104 formed between the swirler vanes 102. In this application, there are a total of twenty swirler vanes 102 and twenty tubes 260 interspersed therebetween. As an alternative, any combination of tubes 260 relative to the spaces 104 between the plurality of swirler vanes 102 could be workable.

A means 268 for supplying combustible fuel to the fuel injection nozzle 14 includes two separate paths; one being a means 270 for supplying combustible fuel external of the nozzle 14 and into each of the spaces 104 between the swirler vanes 102 and another means 272 for supplying combustible fuel to the fuel injection nozzle 14 generally along the combustion axis 140. As an alternative, fuel could be supplied to only a portion of the spaces 104 between the swirler vanes 102 without changing the gist of the invention. As a further alternative, the fuel quantity supplied by the another means 272 for supplying combustible fuel to the fuel injection nozzle 14 generally along the combustion axis 140 could vary from less than 1 percent to 50 percent of the total fuel supplied to the gas turbine engine 10. The means 270 for supplying combustible fuel to the fuel injection nozzle 14 into each of the spaces 104 between the swirler vanes 102 includes the source of fuel and a pump and control mechanism (not shown), the passage 242 in the outer tubular member 240, the reservoir 234, the passage 262 in each of the plurality of tubes 260 and each of the plurality of holes 126. The another means 272 for supplying combustible fuel to the fuel injection nozzle 14 generally along the combustion axis 140 includes the source of fuel and a pump and control mechanism of conventional design (not shown), the passage 256 in . the inner tubular member 254, the passage 222 in the tubular member 220 and the plurality of angled passages 214 in the tip 192.

INDUSTRIAL APPLICABILITY

In use, the gas turbine engine 10 is started in a conventional manner. Gaseous fuel used for fuel, which in this application is between about 10 to 50 percent of the total fuel, and starting is introduced through the passage 222 into the combustor section 12. Further, fuel is introduced through the passage 256 and exits into the plurality of spaces 104 by way of the passages 262 and the holes 126. Combustion air from the compressor section 20 is introduced through the plurality of spaces 104, mixed with the fuel, further mixes within the cavity 110 and is introduced into the combustor 46. In the combustor 6 the pilot fuel from the passage 222 further mixes with the mixed fuel and air from the spaces 104 and the cavity 110 and combustion occurs.

As the engine 10 is accelerated, additional fuel and air are added. More combustion air passes through each of the spaces 104 between the plurality of swirler vanes 102 and more fuel is added to the combustion air as less fuel is introduced through the passage 222. For example, additional fuel is introduced through the passage 242 and into the reservoir 234, passes through the plurality of passages 262, exits the hole 126 and mixes with the combustion air between the radial swirler vanes 102 within the spaces 104. Further mixing of the fuel and the combustion air occurs within the cavity 110 prior to exiting into the combustor 46. Thus, a highly homogeneous mixture is established prior to entering the combustion chamber and combustor section 12. In some gas turbine engine 10 applications, the temperature of the combustion gases most directly exposed to the tip 192 and the end portion 180 are as high as within the range of between about 2500 degrees and 3000 degrees Fahrenheit.

As mentioned above, the temperature of the combustion gases most directly exposed to the injection nozzle 14 is high. Thus, the end of the injector 14 in contact with the combustion gases must be cooled to prevent erosion and premature failure. For example, cooling air enters the injector 14 through the plurality of holes 146 and fills the cooling reservoir 175. The means 216 provides a twofold path through which cooling air can exit the cooling passage 182 and provide cooling to the end portion 180 of the second member 176 and the tip 192. The first flow path 217 is intended to primarily cool the tip 192 and further cool the end portion 180. The second flow path 218 is intended to ensure primary cooling of the end portion 180. The first flow path 217 allows cooling air from the reservoir 175 to enter the plurality of passages 208 in the tip 192 and the chamber 206. From the chamber 206, the cooling air exits the plurality of radial passages 212 enters the cooling passage 182 and exits through the plurality of passages 188 the mixture of air and fuel within the cavity 110 prior to entering the combustor section 12. The second flow path 218 allows cooling air from the reservoir 175 to enter through the plurality of holes 174 into the cooling passage 182 and exits through the plurality of passages 188 into the mixture of air and fuel in the cavity 110 prior to entering the combustor section 12. Thus, the spent cooling air used to cool the end portion 180 of the second member 176 and the tip 192 (first flow path), and the spent cooling air used to cool the end portion 180 of the second member 176 (second flow path) is mixed with the air and fuel mixture within the cavity 110 prior to entering the combustor section 12 resulting in the combustion process in general not being adversely affected.

Reduced pollution has resulted in gas turbine engines 10 by using the above described injector 14. Low NOx is maintained by supplying combustible fuel into each of a plurality of spaces 104 formed between the radial swirler vanes 102. Furthermore, the life of the present structure has been increased by the cooling of a combustion end of a fuel injection nozzle 14. The cooling is accomplished by providing a cooling passage 182 for skin cooling of the portion of the nozzle 14 exposed most directly to the combustion flames. For example, the first flow path 217 and the second flow path 218 increase the life of the nozzle. Thus, the combustor end of the fuel injection nozzle 14 is maintained at a temperature low enough to prevent failure of the combustor end through oxidation, cracking and buckling.

Other aspects, objects and advantages will become apparent from a study of the specification, drawings and appended claims.

I claim:

1. A fuel injection nozzle having a nozzle axis comprising:

a cylindrical housing being coaxially positioned about the nozzle axis, having a first end a second end and defining a plurality of radially extending passages therethrough intermediate the first and second ends;

a first member having a generally cup shaped contour including an open end and a generally radial end portion positioned opposite the end, said first member having the open end attached to the cylindrical housing intermediate the first end and the plurality of radially extending passages, said generally radial end portion having an opening centrally positioned therein;

a second member having a generally cup shaped contour and having a generally radial end portion and an another end attached to the cylindrical housing intermediate the second end and the plurality of radially extending passages, said generally radial end portion having an opening centrally positioned therein;

a cooling passage being formed generally between the first member and the second member and being in communication with the plurality of radially extending passages;

a tip being positioned in the openings in the first and second members coaxial with the nozzle axis and being sealingly attached to the second member;

means for supplying a combustible fuel to the fuel injection nozzle; and means for communicating a flow of cooling fluid through the cooling passage.

2. The fuel injection nozzle of claim 1 wherein said means for communicating includes a generally radial bore within the tip being in communication with the cooling passage.

3. The fuel injection nozzle of claim 1 wherein said means for communicating includes a plurality of passages radially spaced from the nozzle axis having a predetermined depth which bottoms within the tip, a radial bore intersecting with the corresponding ones of the plurality of passages, a chamber formed within the tip and a generally radial bore communicating between the cooling passage and the chamber.

4. The fuel injection nozzle of claim 3 wherein said means for communicating further includes said first member including the generally radial portion having a plurality of holes therein.

5. The fuel injection nozzle of claim 4 wherein said plurality of holes in the generally radial portion has the plurality of holes being evenly spaced therebetween.

6. The fuel injection nozzle of claim 5 wherein said plurality of holes in the generally radial portion are positioned in a generally hexagonal pattern with a hole being positioned at each of the intersection of the sides and at the center of the hexagonal.

7. The fuel injection nozzle of claim 1 wherein said means for supplying a combustible fuel to the fuel injection nozzle includes means for supplying combustible fuel to the fuel injection nozzle generally along the combustor axis, said means for supplying combustible fuel to the fuel injection nozzle includes an inner tubular member having a passage therein, and a plurality of angled passages in the tip.

* * * * *